US005758572A

United States Patent [19]

Hennessy et al.

[11] Patent Number: 5,758,572

[45] Date of Patent: Jun. 2, 1998

[54] SUNKEN RECEPTACLE UNIT WITH RESILIENT RECEPTACLE RETAINING SURFACE

[75] Inventors: Joseph J. Hennessy, Howards Grove; Thomas E. Gaffney, Sheboygan, both of Wis.

[73] Assignee: The Vollrath Company, L.L.C., Wis.

[21] Appl. No.: 866,697

[22] Filed: May 30, 1997

[51] Int. Cl.[6] ..... F24B 9/00; A47J 27/00

[52] U.S. Cl. ..... 99/483; 99/403; 126/369; 126/377; 219/433; 219/437; 219/523; 392/441; 392/447

[58] Field of Search ..... 99/401, 413–417, 99/331, 467, 447, 468, 470, 330; 126/369, 377, 378, 33; 219/432, 433, 437, 523; 392/441, 444, 445, 447, 485

[56] References Cited

U.S. PATENT DOCUMENTS

| | | | |
|---|---|---|---|
| 2,166,470 | 7/1939 | Huber . | |
| 2,231,615 | 2/1941 | Duke . | |
| 2,620,789 | 12/1952 | Gregory . | |
| 2,745,155 | 5/1956 | Collins . | |
| 2,847,552 | 8/1958 | Gates . | |
| 2,924,090 | 2/1960 | Schneller . | |
| 3,130,288 | 4/1964 | Monaco et al. | 126/369 |
| 3,288,054 | 11/1966 | Weprin et al. | 99/447 |
| 3,748,439 | 7/1973 | Ting et al. | 219/353 |
| 3,760,147 | 9/1973 | Tyrey | 219/433 X |
| 3,892,945 | 7/1975 | Lerner | 219/523 X |
| 4,215,267 | 7/1980 | Kaebitzsch | 219/437 X |
| 4,246,955 | 1/1981 | Skala | 99/483 |
| 4,284,880 | 8/1981 | Keiser | 99/403 X |
| 4,306,616 | 12/1981 | Woods, Jr. et al. . | |
| 4,480,174 | 10/1984 | Hummel | 219/497 X |
| 4,731,251 | 3/1988 | Jovanovic | 426/523 X |
| 4,779,605 | 10/1988 | Smith et al. . | |
| 4,797,536 | 1/1989 | Handley | 219/494 |
| 4,915,330 | 4/1990 | Buckley . | |
| 5,045,672 | 9/1991 | Scott | 219/437 |
| 5,069,273 | 12/1991 | O'Hearne . | |
| 5,119,800 | 6/1992 | Roberts et al. . | |
| 5,163,536 | 11/1992 | Tuhro et al. . | |
| 5,203,257 | 4/1993 | Goad . | |
| 5,269,217 | 12/1993 | Goad | 99/483 |
| 5,467,697 | 11/1995 | Hunziker . | |

*Primary Examiner*—Timothy F. Simone
*Attorney, Agent, or Firm*—Foley & Lardner

[57] ABSTRACT

A sunken receptacle unit for insertion in an opening of a counter having a top surface and a bottom surface includes a receptacle having a bottom and a plurality of walls defining an interior cavity, a receptacle support surface extending outwardly from the walls for supporting the receptacle within the opening and a receptacle retaining surface coupled to one of the walls. The receptacle retaining surface moves between a first position beyond the opening for engaging the bottom surface of the counter and a second position within the opening for insertion of the unit through the opening. The receptacle retaining surface is resiliently biased in the first position.

19 Claims, 6 Drawing Sheets

FIG. 10
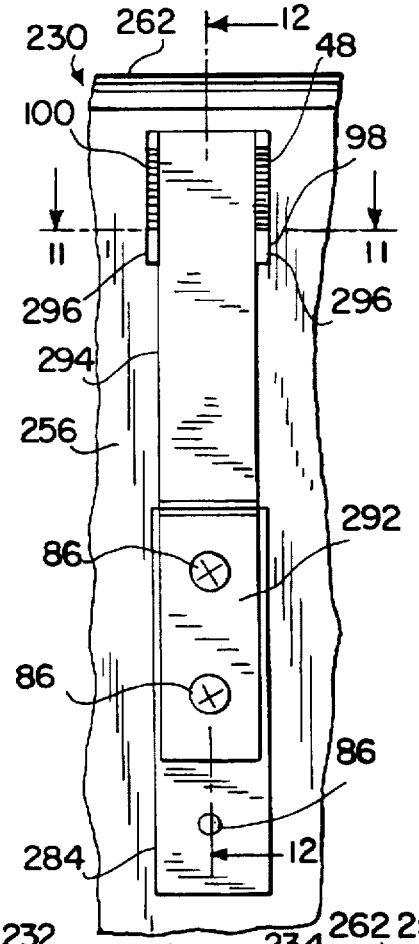
FIG. 8
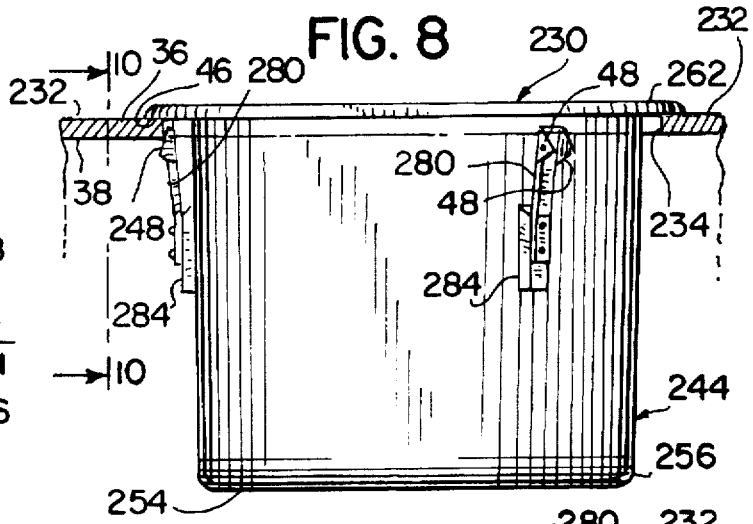
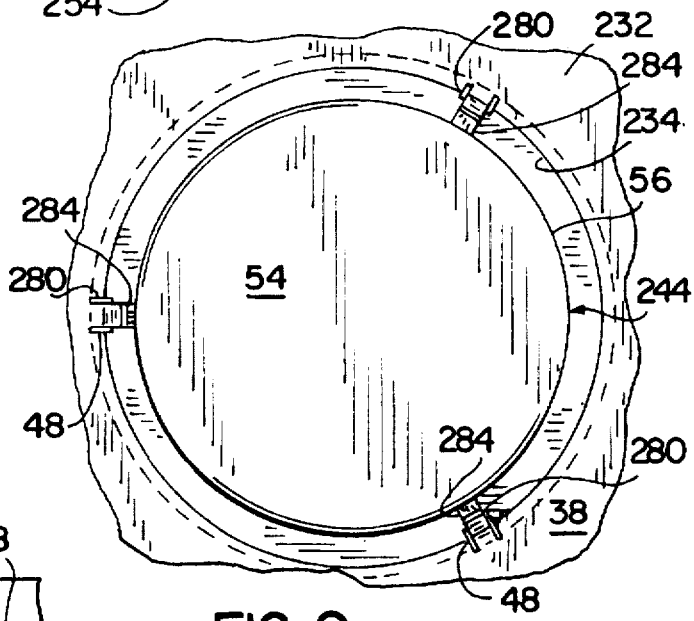
FIG. 9
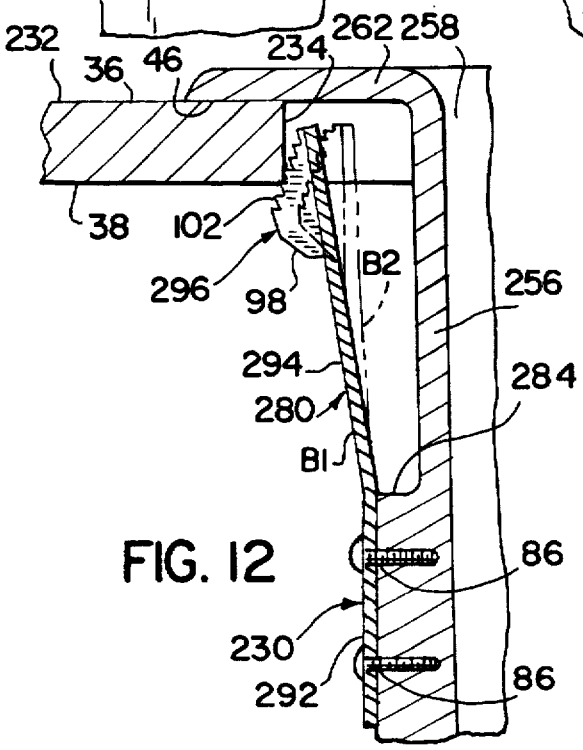
FIG. 12
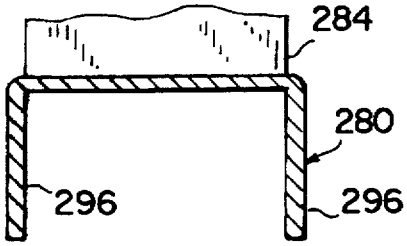
FIG. 11

FIG. 14
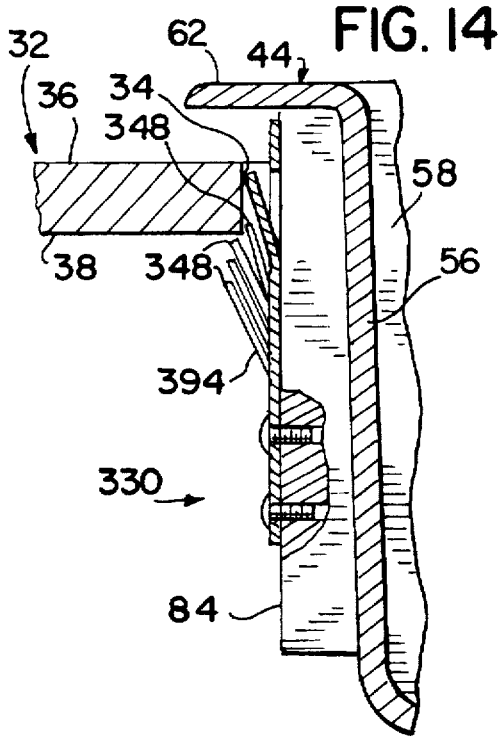
FIG. 15
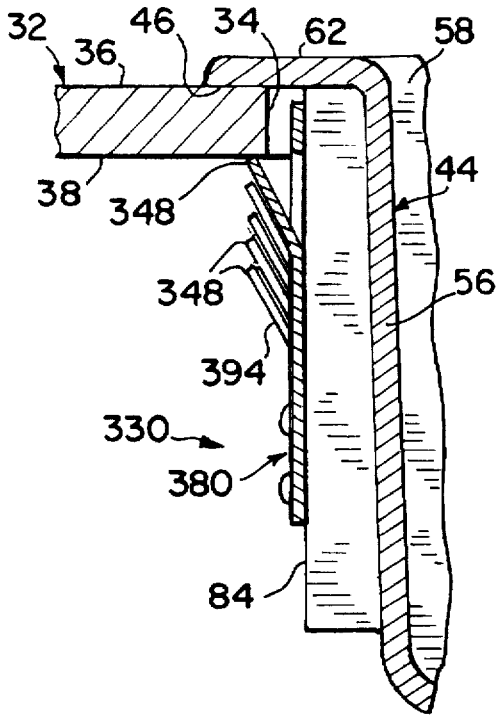
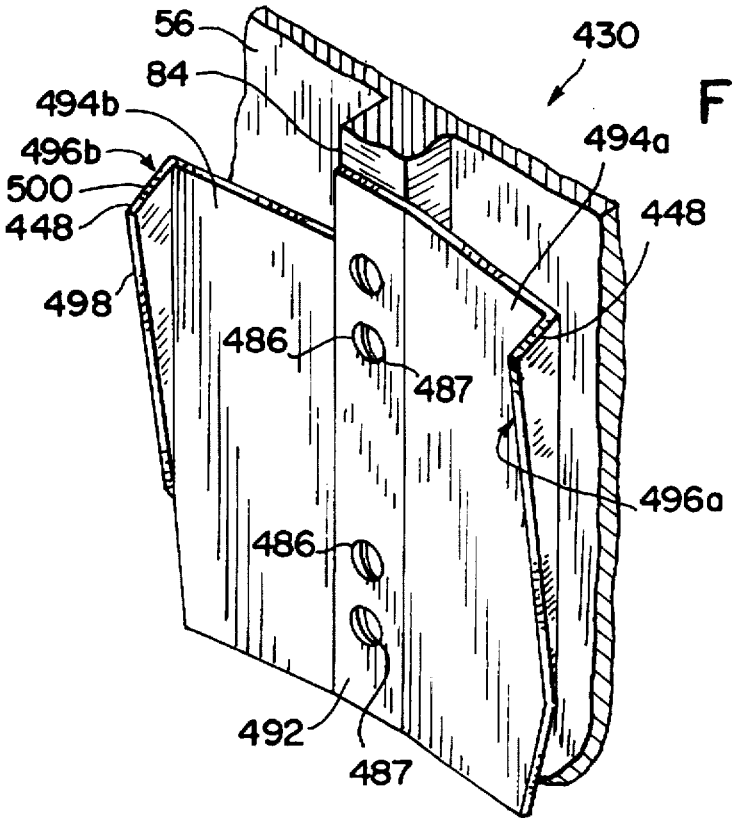
FIG. 16

SUNKEN RECEPTACLE UNIT WITH RESILIENT RECEPTACLE RETAINING SURFACE

FIELD OF THE INVENTION

The present invention relates to sunken receptacle units for insertion into openings in counters. In particular, the present invention relates to a receptacle retainer for securing the receptacle in the counter once the receptacle is inserted through the opening.

BACKGROUND OF THE INVENTION

Sunken receptacle units are conventionally employed by the food service industry to contain food, cooling or warming inner pans or food dishes and utensils. Sunken receptacle units are generally rectangular or circular receptacles and define an interior cavity for a separate inner food pan. The receptacle itself is sized for insertion through an opening in a counter such that a majority of the receptacle is supported below the top of the counter.

Sunken receptacle units have a variety of different sizes and configurations depending upon their particular use. For example, sunken receptacle units are frequently used as a well for receiving hot water or chilled water and for further receiving an inner pan containing food. The hot water or chilled water within the well warms or cools the food within the interior container. Alternatively, sunken receptacle units are frequently used for dispensing food dishes and utensils or for foods such as toppings, condiments, and sauces.

Because sunken receptacle units are used in the service of food, it is critical that the connection between the sunken receptacle unit and the counter be sufficiently sealed to avoid sanitary problems such as leakage of water or foodstuffs. This need is exemplified in many local health department codes regulating such seals.

As a result, a multitude of mechanisms have been devised for securing a sunken receptacle unit within the opening of a counter to seal between the sunken receptacle unit and the counter. Several of these mechanisms fixedly attach the sunken receptacle unit to the counter below the counter. For example, in one such mechanism, a threaded bolt is welded to an underside of the sunken receptacle unit and is inserted through a corresponding hole or slot in the counter. To secure the retainer to the counter, an installer must access the underside of the counter to thread a nut onto the bolt so as to clamp the sunken receptacle unit to the counter.

In another well-known clamping mechanism, a twist clamp is spot welded to the sunken receptacle unit. To secure the sunken receptacle unit to the counter, an installer must access the underside of the counter to twist the clamp about a corresponding member connected to the counter so as to clamp the sunken receptacle unit to the counter.

U.S. Pat. No. 3,361,089 describes a clamping mechanism in which a hinge is provided with one side of the hinge attached to the receptacle and the other side of the hinge secured to the counter by a screw that threads through a bolt contained in the movable side of the hinge. To secure the sunken receptacle unit to the counter, an installer must access the underside of the counter to thread the screw into the bolt to draw the hinges together so as to clamp the sunken receptacle unit to the counter. Each of the aforementioned clamping mechanisms which fixedly attach the sunken receptacle unit to the counter require attachment mechanisms coupled to both the sunken receptacle unit and the counter for attaching the sunken receptacle unit to the counter. As a result, these securing mechanism are more complicated, expensive to manufacture and are subject to failure.

In an attempt to simplify the securing of the sunken receptacle unit to the counter, several alternative mechanisms have been devised which are connected to the sunken receptacle unit and which merely engage the underside of the counter to retain the sunken receptacle unit within the counter. One such mechanism utilizes a multitude of tabs secured to and about the perimeter of the receptacle. Each tab extends generally parallel to the receptacle so as to enable the receptacle to be inserted through the opening in the counter. Once the receptacle is inserted through the opening in the counter, the tabs are manually bent outwardly so as to obliquely extend from the receptacle into contact with the lower surface of the counter to secure the receptacle to the counter. Because the tabs must be manually bent after the receptacle is inserted through the opening of the counter, the installer must gain access to the tabs below the counter.

Another such mechanism is described in U.S. Pat. No. 4,779,605. U.S. Pat. No. 4,779,605 describes a clamping mechanism in which the receptacle is secured to the counter by actuating a threaded member so as to urge a clamping member towards and into engagement against the bottom surface of a counter.

Each of the aforementioned mechanisms requires the installer to access the underside of the counter to secure the sunken receptacle unit to the counter. Typically, space and visibility below the counter are extremely limited. As a result, installation of the sunken receptacle unit to the counter is tedious, time consuming and expensive.

SUMMARY OF THE INVENTION

A sunken receptacle unit for insertion in an opening of a counter having a top surface and a bottom surface includes a receptacle having a bottom and a plurality of walls defining an interior cavity, a receptacle support surface extending outwardly from the walls for supporting the receptacle within the opening and a receptacle retaining surface coupled to one of the walls. The receptacle retaining surface moves between a first position beyond the opening for engaging the bottom surface of the counter and a second position within the opening for insertion of the unit through the opening. The receptacle retaining surface is resiliently biased in the first position.

In one preferred embodiment, the receptacle retaining a surface flexes between the first position and the second position. In a more preferred embodiment, the receptacle retaining surface is supported by a resilient wing coupled between the first receptacle retaining surface and the wall of the receptacle.

In another preferred embodiment, the sunken receptacle unit includes a second receptacle retaining surface similar to the first receptacle retaining surface but vertically spaced from the first receptacle retaining surface. In yet another preferred embodiment, the sunken receptacle unit includes a second receptacle retaining surface similar to the first receptacle retaining surface but horizontally spaced from the first receptacle retaining surface. In the most preferred embodiment, the first receptacle retaining surface is vertically adjustable along the wall for accommodating various counter thicknesses.

In another preferred embodiment, the sunken receptacle unit includes a second receptacle retaining surface resiliently biased so as to engage an inner side of the opening. In a more preferred embodiment, the sunken receptacle unit includes a plurality of teeth, wherein one of the teeth defines the first receptacle retaining surface. In the most preferred embodiment, at least one of the teeth is configured for engaging both the bottom side of the counter and an inner side of the opening.

BRIEF DESCRIPTION OF THE DRAWINGS

FIG. 8 is a side-elevational view of a second embodiment of the sunken receptacle unit supported adjacent a counter with portions of the counter broken away.

FIG. 9 is a bottom-elevational view of the sunken receptacle unit of FIG. 8 supported adjacent the counter.

FIG. 10 is a fragmentary side-elevational view of the sunken receptacle unit of FIG. 8 taken along lines 10—10.

FIG. 11 is a fragmentary sectional view of the sunken receptacle unit of FIG. 10 taken along lines 11—11.

FIG. 12 is a sectional view of the second embodiment of the sunken receptacle unit supported adjacent the counter.

FIGS. 14 and 15 are fragmentary sectional views illustrating the sunken receptacle unit of FIG. 13 being inserted through an opening of the counter.

FIG. 16 is a fragmentary perspective view of a fourth embodiment of the sunken receptacle unit.

DETAILED DESCRIPTION OF THE PREFERRED EMBODIMENT

I. First Embodiment (FIGS. 1–7)

Figure 1:
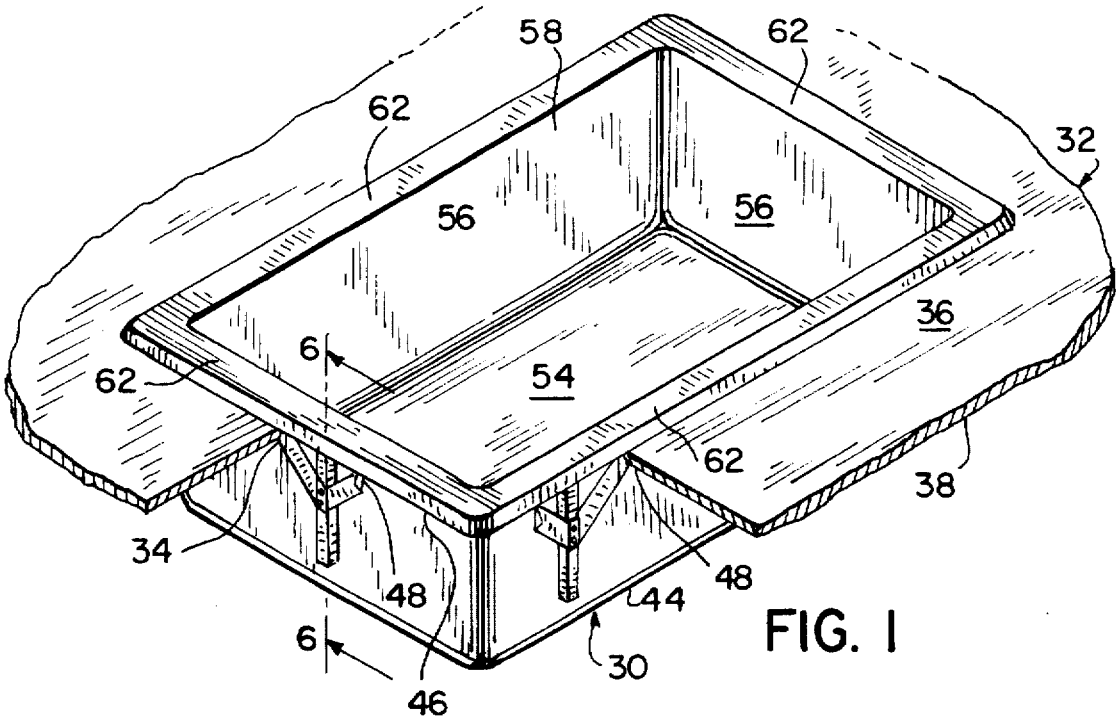
FIG. 1 is a perspective view of a preferred embodiment of a sunken receptacle unit supported adjacent a counter with portions of the counter broken away.

FIG. 1 is a perspective view of sunken receptacle unit 30 supported adjacent counter 32. For purposes of illustration, portions of counter 32 are broken away. Counter 32 is a conventionally known counter defining an opening 34, a top surface 36 and a bottom surface 38. In the preferred embodiment illustrated, top surface 36 is a generally horizontal surface surrounding sunken receptacle unit 30. Top surface 36 is preferably sufficiently sized for at least partially supporting sunken receptacle unit 30 and for supporting other items such as dishes, utensils and the like. Bottom surface 38 extends generally opposite top surface 36 and is spaced from top surface 36 depending upon the thickness of counter 32.

As better shown by FIGS. 2–6, counter 32 further includes an inner side or surface 40 extending about and defining opening 34. Opening 34 is sized for receiving sunken receptacle unit 30 so that a majority of sunken receptacle unit 30 is supported below top surface 36. In the preferred embodiment illustrated, opening 34 is preferably large enough to permit sunken receptacle unit 30 to be inserted through counter 32 yet small enough such that counter 32 at least partially supports sunken receptacle unit 30. As can be appreciated, counter 32 may have a variety of alternative sizes, shapes and configurations depending upon the size, shape and configuration of sunken receptacle unit 30 as well as the particular use of counter 32 and sunken receptacle unit 30. For example, counter 32 may be integrally formed as part of a cabinet. Alternatively, counter 32 may be formed as part of a portable food service structure which rests upon a floor or upon a top of a table or cabinet.

Sunken sunken receptacle unit 30 mounts within opening 34 and generally includes receptacle 44, receptacle support surface 46 and receptacle retaining surfaces 48. Receptacle 44 is a pan or container sufficiently sized for containing and holding food items or food service items such as warmer pans, dishes, utensils and the like. Receptacle 44 includes bottom 54, walls 56 and interior cavity 58. Bottom 54 and walls 56 define interior cavity 58 for containing and holding the food items and food service items. As shown by FIG. 1, counter 32 supports receptacle 44 so that a majority of interior cavity 58 extends below top surface 36 of counter 32. As further shown by FIG. 1, interior cavity 58 of receptacle 44 preferably opens above top surface 36 to permit easy access to interior cavity 58.

Receptacle support surface 46 extends outwardly from walls 56 for supporting receptacle 44 upon counter 32. In the preferred embodiment illustrated, receptacle support surface 46 is defined by flanges 62. Flanges 62 outwardly extend from walls 56 about interior cavity 58. Each flange 62 preferably extends outwardly from walls 56 by a sufficient distance so that receptacle support surface 46 defined on the bottom surface of each flange 62 rests upon and engages top surface 36 of counter 32 to support receptacle 44. In the preferred embodiment illustrated, receptacle support surface 46 additionally includes sealing means, such as a gasket, for ensuring a sanitary seal between flanges 62 and counter 32. Because flanges 62 extend outwardly from receptacle 44 adjacent a top opening of interior cavity 58, receptacle 44 may be merely dropped through opening 34 of counter 32 until flanges 62 rest upon top surface 36 of counter 32. Thus, access to below counter 32 is not required for supporting receptacle 44 upon counter 32. Alternatively, receptacle support surface 46 may be defined by various other members other than flanges 62 for supporting receptacle 44 relative to counter 32. Although less preferable, support surface 46 may alternatively engage surfaces other than top surface 36 of counter 32 for supporting receptacle 44 relative to counter 32.

Once receptacle 44 is inserted through opening 34 of counter 32, receptacle retaining surfaces 48 prevent or restrict removal of receptacle 44 from within opening 34 of counter 32 and clamp flanges 62 against top surface 36. Receptacle retaining surfaces 48 are coupled to walls 56 for movement between a first position beyond opening 34 for engaging bottom surface 38 of counter 32 and a second position within opening 34 for enabling insertion of bottom 54 and walls 56 of receptacle 44 through opening 34. Receptacle retaining surfaces 48 are resiliently biased in the first position. During insertion of sunken receptacle unit 30 through opening 34 of counter 32, receptacle retaining surfaces 48 are in the second position to permit receptacle 44 to be dropped through opening 34. However, once receptacle 44 has been sufficiently inserted through opening 34, receptacle retaining surfaces 48 automatically move to the first position so as to engage bottom surface 38 of counter 32 to prevent or at least impede removal of sunken receptacle unit 30 from counter 32. In addition, because receptacle retaining surfaces 48 engage bottom surface 38 to compress receptacle support surface 48 against top surface 36, receptacle retaining surfaces 48 assist in providing a sanitary seal between sunken receptacle unit 30 and counter 32. These results are achieved without the necessity of an installer having to access space below counter 32 during installation. Thus, installation of second sunken receptacle unit 30 is less tedious, time consuming and expensive.

Figures 2, 3, 7A, 7B:
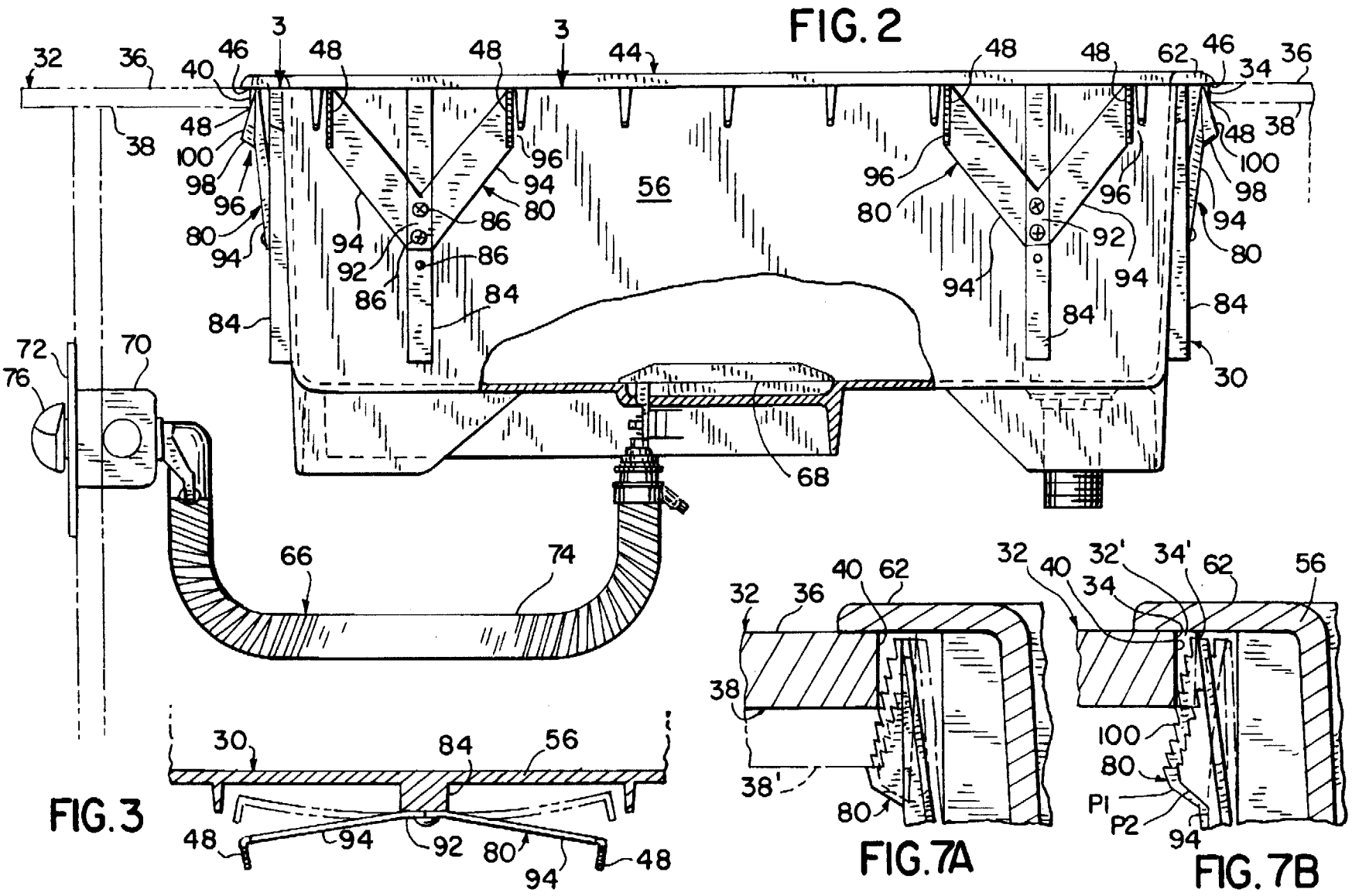
FIG. 2 is a side-elevational view of the sunken receptacle unit supported adjacent the counter which is shown in phantom.
FIG. 3 is a fragmentary cross-sectional view of the sunken receptacle unit taken along lines 3—3 of FIG. 2.
FIG. 7A is a fragmentary cross-sectional view of the sunken receptacle unit supported adjacent to counters having various thicknesses.
FIG. 7B is a fragmentary cross-sectional view of the sunken receptacle unit supported adjacent to counters having different sized openings.

FIG. 2 is a side elevational view illustrating the preferred embodiment of sunken receptacle unit 30 in greater detail. Although sunken receptacle unit 30 may have a variety of alternative uses, FIG. 2 illustrates sunken receptacle unit 30 utilized as part of a food warmer well supported by counter 32 (shown in phantom). Because sunken receptacle unit 30 is illustrated for use as a food warmer well, sunken receptacle unit 30 additionally includes receptacle heating mechanism 66. Receptacle heating mechanism 66 is conventionally known and generally includes heating element 68, and temperature/power control 70. Heating element 68 preferably comprises a 1,000 watt heating element supported adjacent receptacle 44 for heating contents of interior cavity 58. Heating element 68 heats in response to power provided by temperature/power control 70.

Temperature/power control 70 is conventionally known and includes control box 72, conduit 74 and a thermostat (not shown). Control box 72 includes a control button 76 for varying the amounts of power supplied to heating element 68 through conduit 74. In response, heating element 68 heats the contents of interior cavity 58. The thermostat (not shown) senses the temperature of heating element 68 to assist in controlling the heating of the contents. Control box 72 is preferably mounted to counter 32.

As further shown by FIG. 2, receptacle support surfaces 48 are preferably defined as edges of resilient outwardly biased counter engaging members 80. Counter engaging members 80 extend from receptacle 44 to resiliently support receptacle retaining surfaces 48 in engagement with bottom surface 38 of counter 32. Counter engaging members 80 are preferably mounted to corresponding ribs 84 of receptacle 44. Ribs 84 extend along an exterior surface of walls 56 and project outwardly from walls 56 for enabling counter engaging members 80 to be easily mounted to receptacle 44 without impelling the integrity of interior cavity 58 (shown in FIG. 1). In addition, ribs 84 define a plurality of vertically spaced connection points 86 for enabling vertical adjustment of counter engaging members 80 relative to receptacle 44. As a result, the plurality of connection points 86 enable vertical adjustment of receptacle retaining surfaces 48 to accommodate counters having a wide range of thicknesses between top surface 36 and bottom surface 38. Although connection points 86 are illustrated as comprising a plurality of vertically spaced holes along ribs 84 for threadably receiving screws to mount counter engaging members 80, various other alternative vertical adjustment mechanisms may be used to enable counter engaging members 80 to be vertically adjusted relative to receptacle 44. For example, each counter engaging member 80 may alternatively be slidably coupled and connected directly to receptacle 44 or to ribs 84 for permitting virtually infinite vertical adjustment of receptacle retaining surfaces 48 relative to receptacle 44. Alternatively, counter engaging member 80 may be welded to, or integrally formed with ribs 84 or walls 56 of receptacle 44.

In the preferred embodiment illustrated, each counter engaging member 80, which defines receptacle retaining surfaces 48, preferably includes mounting portion 92, wings 94 and wing tips 96. Mounting portion 92 is a generally flat portion extending between wings 94 and is configured for mating against rib 84 so as to couple counter engaging member 80 to rib 84.

Wings 94 extend from opposite sides of mounting portion 92 and are upwardly angled so as to provide counter engaging member 80 with a generally V-shaped configuration. As best shown by FIG. 3, wings 94 extend outwardly away from wall 56. Preferably, wings 94 extend outwardly away from walls 56 by a sufficient distance such that receptacle retaining surfaces 48 are supported beyond opening 34 in engagement with bottom surface 38 of counter 32 when in the first position. Wings 94 support wing tips 96 in engagement with counter 32 in the first position.

Wing tips 96 extend outwardly from the ends of wings 94 for engagement with bottom surface 38 of counter 32. In the preferred embodiment illustrated, wing tips 96 extend generally perpendicular to wings 94 and generally perpendicular to planar surfaces of wall 56. Wing tips 96 are horizontally spaced from one another and define receptacle retaining surfaces 48. Although counter engaging members 80 defining receptacle retaining surfaces 48 are illustrated as V-shaped winged members having edges which define receptacle retaining surfaces 48, counter engaging members 80 may alternatively have any one of a variety of different shapes and configurations depending upon the size, shape and configuration of receptacle 44, the means by which counter engaging members 80 are coupled to receptacle 44 and the particular configuration of counter 32.

FIG. 3 is a cross-sectional view of a portion of sunken receptacle unit 30 taken along lines 3—3 of FIG. 2. As best shown by FIG. 3, wings 94 of counter engaging member 80 inwardly flex towards wall 56. Because rib 84 projects outwardly away from wall 56 and supports mounting portion 92 of counter engaging member 80, rib 84 increases the distance that wings 94 may flex towards wall 56. As shown by FIG. 3, wings 94 generally flex from a first outwardly facing concave relationship to an outwardly facing convex relationship shown in phantom. As a result, receptacle retaining surfaces 48 supported by wings 94 may move through a larger distance to accommodate various counters having various sized openings. In the preferred embodiment illustrated, wings 94 of counter engaging member 80 are configured and formed from aluminized carbon steel for enabling receptacle retaining surfaces 48 to flex between the first position in which receptacle retaining surfaces 48 extend beyond opening 34 to engage counter 32 and a second position in which receptacle retaining surfaces 48 are within opening 34 for permitting unit 30 to be inserted through opening 34.

Figure 4:
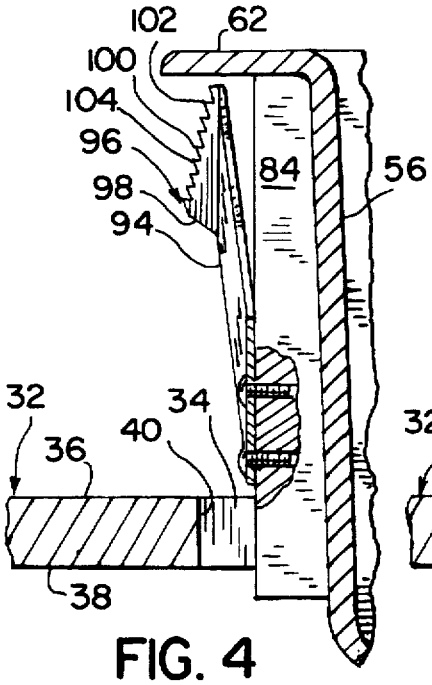
FIGS. 4–6 are fragmentary cross-sectional views illustrating the sunken receptacle unit being inserted through an opening of the counter.
Figure 5:
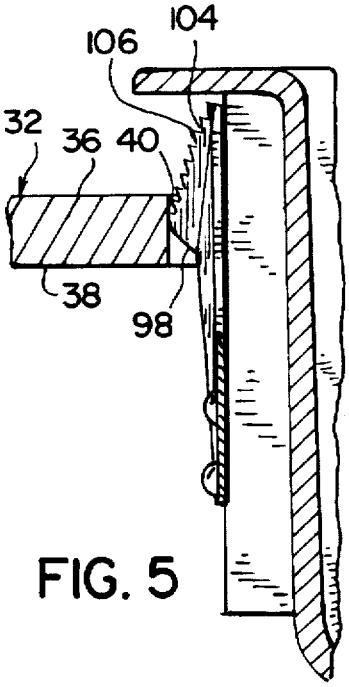
Figure 6:
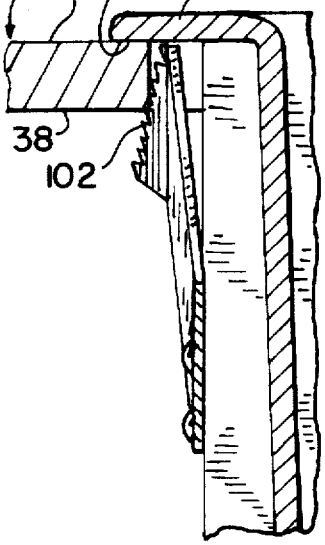

FIGS. 4–6 illustrate progressive insertion of sunken receptacle unit 30 in opening 34 of counter 32. FIGS. 4–6 also illustrate wing tips 96 in greater detail. As best shown by FIGS. 4–6, wing tips 96 include edges 98 and 100. Edge 98 slopes upwardly and outwardly from wing 94. As best shown in FIG. 5, during insertion of sunken receptacle unit 30 into opening 34, edge 98 engages inner side 40 of opening 34 so as to progressively flex wing 94 towards wall 56.

Edge 100 is sloped upwardly and inwardly from edge 98 towards wing 94. Edge 100 extends along an axis oblique to wall 56. Edge 100 defines receptacle retaining surfaces 48. In the preferred embodiment illustrated in FIGS. 4–6, edge 100 defines a plurality of serrations or teeth 102. Each tooth 102 includes an upper generally horizontal surface 104 and a lower angled surface 106. The generally horizontal surface 104 of each tooth 102 serves as an individual receptacle retaining surface 48. Each lower angled surface 106 of each tooth enables the tooth 102 to be forced downwardly through opening 34 until surface 104 engages bottom surface 38 of counter 32. In the preferred embodiment illustrated, teeth 102 are preferably vertically spaced from one another along edge 100 in increments of $^{40}/_{1000}$ inches. Surfaces 104 of teeth 102 provide a sufficient surface area for engaging bottom surface 38 of counter 32 to stably secure second sunken receptacle unit 30 to counter 32. Surfaces 104 of teeth 102 enable wing tip 96 to have a steeper angle relative to wings 94 to accommodate the reduced width of flange 62. Alternatively, given a wider flange 62, teeth 102 may be omitted in favor of edge 100 extending outwardly at a shallower angle relative to wings 94. Because teeth 102 are vertically spaced along edge 100 of wing tip 96, teeth 102 provide a plurality of vertically spaced receptacle retaining surfaces 48 for engaging bottom surface 38 of counter 32 regardless of the thickness of counter 32.

As shown by FIG. 4, wing 94 resiliently biases teeth 102 and receptacle retaining surfaces 48 in the first position beyond opening 34 prior to full insertion of sunken receptacle unit 30 through opening 34. As shown by FIG. 5, during insertion of sunken receptacle unit 30 through opening 34, inner side 40 of opening 34 engages lower edge 98 of wing tip 96 to flex wing 94 inwardly towards rib 84 and wall 56. During insertion of sunken receptacle unit 30 through opening 34, teeth 102 and receptacle retaining surfaces 48 are moved into the second position within opening 34. As shown by FIG. 6, as receptacle support surface 46 below flange 62 is moved towards top surface 36 of counter 32, each tooth 102 is progressively forced below bottom surface 38 of counter 32. Because wing 94 resiliently biases each retaining surface 48 formed on upper surfaces 104 of each tooth 102 beyond opening 34, insertion of sunken receptacle unit 30 through opening 34 ratchets wing tip 96 tooth-by-tooth past bottom surface 38 until receptacle support surface 46 of flange 62 is pressed against top surface 36 to provide a sanitary seal between counter 32 and sunken receptacle unit 30. In this position, receptacle retaining surface 48 is defined by the upper surface 104 of the particular tooth 102 in engagement with bottom surface 38. Receptacle retaining surface 48 prevents upward movement of sunken receptacle unit 30 and receptacle support surface 46 away from top surface 36 of counter 32 to maintain the sanitary seal.

FIGS. 7A and 7B are fragmentary cross-sectional views illustrating the ability of sunken receptacle unit 30 to adapt to counters having various thicknesses and various sized openings 34. As best shown by FIG. 7A, because edge 100 of wing tips 96 slopes upwardly and inwardly from edge 98 and because edge 100 flexes both towards and away from wall 56, edge 100 automatically adapts to counters having varying thicknesses between top surface 36 and bottom surface 38. For example, edge 100 automatically adapts to engage either bottom surface 38 or bottom surface 38' to clamp flange 62 against top surface 36. In the preferred embodiment illustrated in which edge 100 includes teeth 102, different vertically spaced teeth 102 engage bottom surfaces 38 and 38' depending upon the thickness of counter 32. Alternatively, where edge 100 is smooth, different points along edge 100 engage bottom surfaces 38 and 38'.

FIG. 7B illustrates the ability of sunken receptacle unit 30 to accommodate different counters having different sized openings 34. FIG. 7B illustrates wings 94 flexing between a first position P1 and a second position P2 to accommodate a first counter 32 having a first opening 34 and a second counter 32' having a second opening 34', respectively. As shown by FIG. 7B, wings 94 flex inwardly and outwardly towards and away from wall 56 so as to automatically bias edge 100 against counter 32 independent of the size of opening 34. As a result, sunken receptacle unit 30 enables the use of counters having openings 34 manufactured with less precise manufacturing tolerances. In addition to engaging bottom surface 38 of counter 32 to clamp counter 32 between flange 62 and edge 100 of wing tips 96, edge 100 of wing tips 96 also engage inner sides 40 of opening 34 to apply an outward horizontal force to counter 32. As a result, this force applied by counter engaging members 80 against counter 32 limits or prevents undesirable horizontal movement of sunken receptacle unit 30 relative to counter 32.

II. Second Embodiment (FIGS. 8–12)

FIGS. 8–12 illustrate sunken receptacle unit 230, a second embodiment of sunken receptacle unit 30, supported adjacent counter 232. Sunken receptacle unit 230 and counter 232 are similar to sunken receptacle unit 30 and counter 32 illustrated in FIGS. 1–7 except that sunken receptacle unit 230 is generally circular in shape for being received within a circular opening 234 in counter 232. For ease of description, those elements of sunken receptacle unit 230 and counter 232 which are the same as corresponding elements of sunken receptacle unit 30 and counter 32 are numbered similarly. As shown by FIGS. 8 and 9, counter 232 is similar to counter 32 except that counter 232 defines a generally circular opening 234 sized for receiving sunken receptacle unit 230. Accordingly, sunken receptacle unit 230 mounts within opening 234 and generally includes receptacle 244, and counter engaging members 280. Receptacle 244 is a generally circular pan or container sufficiently sized for containing and holding food items or food service items such as warmer pans, dishes, utensils and the like. Receptacle 244 includes bottom 254, walls 256, interior cavity 258 (shown in FIG. 12) and outer rim or flange 262. Bottom 254 and walls 256 define interior cavity 258 for containing and holding the food items and food service items. Interior cavity 258 is generally circular in shape. Interior cavity 258 preferably opens above top surface 36 of counter 232 to permit easy access to interior cavity 258. Because walls 256 and interior cavity 258 are circular in shape, flange 262 circumferentially extends about interior cavity 258 from walls 256. Similar to flange 62, flange 262 includes a bottom surface defining a receptacle support surface 46 which presses against top surface 36 of counter 232 to form a tight sanitary seal between flange 262 and counter 232. In addition, flange 262 supports sunken receptacle unit 230 adjacent to counter 232. As previously noted, flange 262 may additionally include a gasket to seal between flange 262 and counter 232.

Ribs 284 outwardly extend from walls 256 about receptacle 244. As with ribs 84, ribs 284 support counter engaging members 280 to space counter engaging members 280 from walls 256 and to mount counter engaging members 280 to receptacle 244.

Counter engaging members 280 are fixedly coupled to ribs 284 and extend into engagement with bottom surface 38 of counter 232 about opening 234. As best shown by FIG. 8, sunken receptacle unit 230 preferably includes three counter engaging members 280 supported approximately 120 degrees about receptacle 244. Because counter engaging members 280 are equidistantly spaced about receptacle 244 by approximately 120 degrees, receptacle 244 is less likely to pivot or move in any one direction. Alternatively, receptacle 230 may include less than or greater than three counter engaging members 280 supported about receptacle 244. Although receptacle 244 is illustrated as having a circular interior cavity 258 for being received through a circular opening 234, receptacle 244 and opening 234 may alternatively have other non-rectangular shapes such as oval, hexagonal or octagonal shapes.

As with counter engaging members 80, counter engaging members 280 resiliently support receptacle retaining surfaces 248 for movement between a first position beyond opening 234 for engaging bottom surface 38 of counter 232 and a second position within opening 234 for insertion of sunken receptacle unit 230 through opening 234. Counter engaging members 280 preferably resiliently bias receptacle retaining surfaces 248 in the first position.

FIGS. 10–12 illustrate counter engaging members 80 in greater detail. FIG. 10 is a side elevational view of sunken receptacle unit 230 taken along lines 10—10 of FIG. 8 with counter 232 removed for purposes of illustration. FIG. 11 is a fragmentary sectional view taken along lines 11—11 of FIG. 10 illustrating counter engaging member 280 supported by rib 284. FIG. 12 is a cross-sectional view taken along lines 12—12 of FIG. 10 illustrating sunken receptacle unit 230 supported by an engagement with counter 232. As best shown by FIGS. 10 and 11, counter engaging member 280 includes a mounting portion 292, wing 294 and wing tips 96. Mounting portion 292 is a generally flat portion extending below wing 94 and is configured for mating against rib 284 so as to couple counter engaging member 280 to rib 84. Similar to rib 84, rib 284 includes a plurality of connection points 86 for mounting counter engaging member 280 to walls 256 at various vertical locations.

Wing 94 is preferably integrally formed with mounting portion 292 and extends vertically upward and from mounting portion 292 and outward from walls 256 by sufficient distance such that wing tips 96 support receptacle retaining surfaces 48 beyond opening 34 for engagement with bottom surface 38 of counter 232. Wing 294 is preferably configured and made from a resilient flexible material, such as aluminized carbon steel, such that wing 94 flex towards walls 256 upon receiving sufficient force during insertion of sunken receptacle unit 230 through opening 234.

Wing tips 296 are essentially identical to wing tips 96 except that wing tips 296 are spaced closer together to accommodate the circular configuration of opening 34. As with wing tips 96, wing tips 296 extend generally perpendicular to wing 94 and include edges 98 and 100. Edge 100 slopes upwardly and outwardly from wing 94 so as to compress wing 294 towards walls 256 as sunken receptacle unit 230 is inserted through opening 234. Edge 100 slopes upwardly and inwardly towards wing 294 and defines a plurality of vertically spaced receptacle retaining surfaces 48. In the preferred embodiment illustrated, receptacle retaining surfaces 48 are defined upon upper horizontal surfaces of teeth 102.

As best shown by FIG. 12, wing 294 flexes between a first position B1 and a second position B2 (shown in phantom). During insertion of sunken receptacle unit 230 through opening 234, wing tips 296 engage counter 232 to compress and flex wing 294 to position B2 (shown in phantom). As a result, retaining surfaces 48 defined by teeth 102 are positioned within opening 234 to allow insertion of sunken receptacle unit 230 through opening 234. As each retaining surface 48 on each tooth 102 is lowered below bottom surface 38, wing 94 biases surfaces 48 towards their initial position so as to locate each receptacle retaining surface below bottom surface 38 beyond opening 234 for engaging bottom surface 38. Consequently, as sunken receptacle unit 230 is inserted through opening 234, teeth 102 ratchet past bottom surface 38 so as to engage bottom surface 38 to clamp flange 262 against top surface 36 of counter 232.

III. Third Embodiment (FIGS. 13–15)

Figure 13:
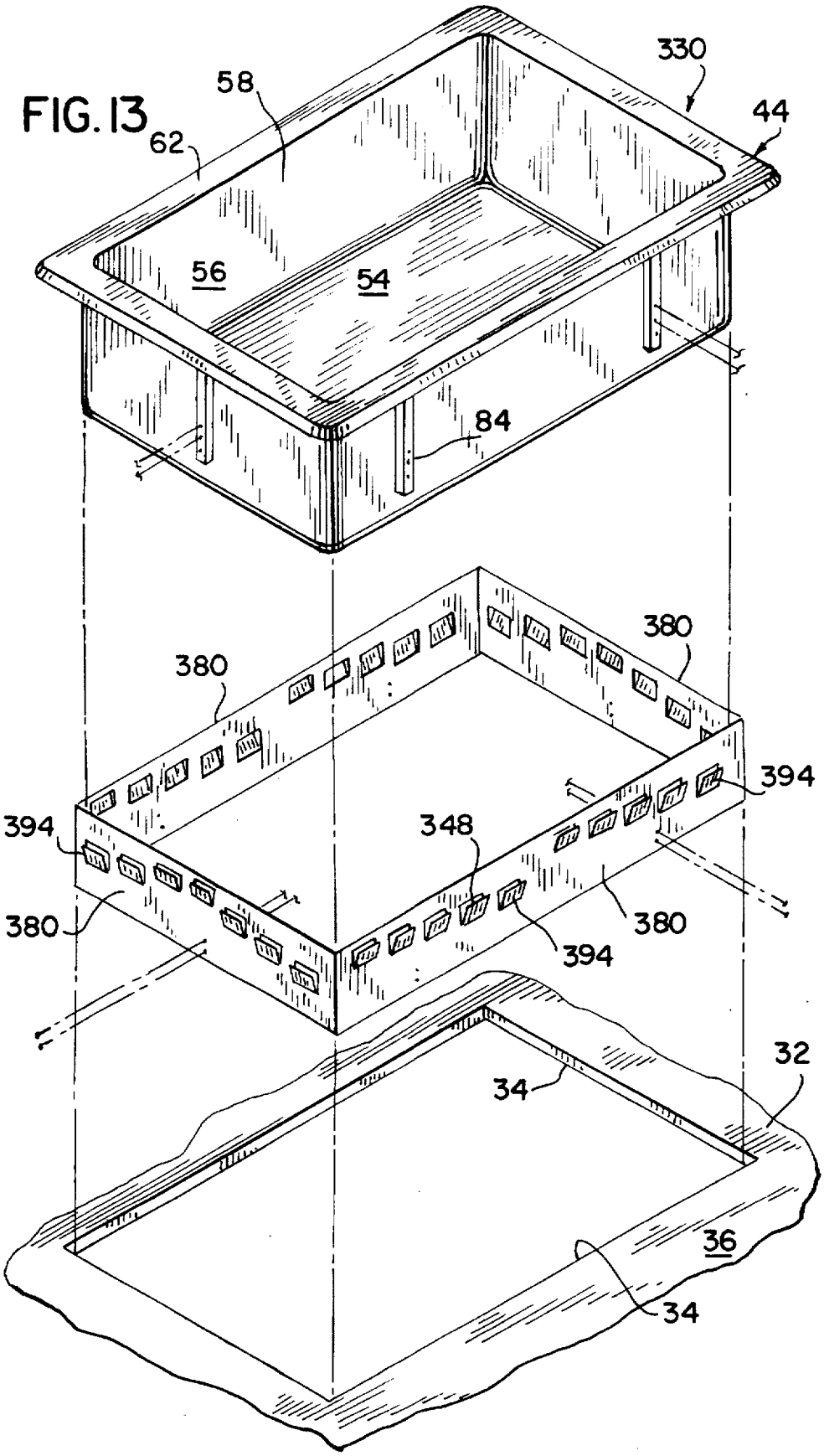
FIG. 13 is an exploded perspective view of a third embodiment of the sunken receptacle unit for being supported adjacent a counter.

FIG. 13 is an exploded perspective view of sunken receptacle unit 330, a third embodiment of sunken receptacle unit 30, configured for being supported within opening 34 of counter 32. Sunken receptacle unit 330 is similar to sunken receptacle unit 30 except that sunken receptacle unit 330 includes counter engaging member 380 in lieu of counter engaging members 80. For ease of illustration, those remaining elements of sunken receptacle unit 330 which are the same as corresponding elements of sunken receptacle unit 30 are numbered similarly. Counter engaging members 380 are generally elongate panels configured for being mounted to ribs 84 along walls 56 of receptacle 44. In the preferred embodiment illustrated, counter engaging members 380 are formed as a single rectangular sleeve which mounts about receptacle 44. Alternatively, counter engaging members 380 may be individually formed and mounted adjacent walls 56. Each counter engaging member 380 includes a plurality of vertically and horizontally spaced wings 394 extending along an outer surface of each counter engaging member 380. Wings 394 are generally outwardly and upwardly angled flaps vertically and horizontally positioned along counter engaging member 380. Each wing 394 defines a receptacle retaining surface 348 along its upper horizontal edge. Each wing 394 preferably angles away from wall 56 a sufficient distance so as to position receptacle retaining surface 348 beyond opening 34. Each wing 394 is preferably configured and made from a resilient flexible material, such as aluminized carbon steel, so as to outwardly bias retaining surface 348 beyond opening 34 while also permitting wing 394 to flex so as to position receptacle retaining surface 348 within opening 34 during insertion of sunken receptacle unit 330 through opening 34 of counter 32.

FIG. 14 illustrates insertion of sunken receptacle unit 330 through opening 34 of counter 32. As shown by FIG. 14, during insertion of sunken receptacle unit 330 through opening 34, wings 394 are successively flexed inwardly towards wall 56 such that its upper edge defining receptacle retaining surfaces 348 is within opening 34. However, once the entire wing, including receptacle retaining surface 348 is positioned below bottom surface 38 of counter 32, wing 394 resiliently returns to its original position so as to position receptacle retaining surface 38 below bottom surface 38.

FIG. 15 illustrates sunken receptacle unit 330 fully inserted through opening 34 of counter 32. As shown by FIG. 15, receptacle retaining surface 348 of an uppermost wing 394 engages bottom surface 38 to force bottom surface 38 towards flange 62 to provide a sanitary seal between counter 32 and flange 62 and to prevent removal of receptacle 330 from counter 32. Because wings 394 are vertically spaced relative to one another so as to provide a plurality of vertically spaced receptacle retaining surfaces 348, counter engaging member 380 automatically engages bottom surface 38 of the counter independent of the counter's thickness. Because wings 394 are outwardly biased so as to support and position receptacle retaining surfaces 348 beyond opening 34, wings 394 automatically position receptacle retaining surface 348 below and in engagement with bottom surface 38 once receptacle 44 is inserted through opening 34. As a result, an installer does not need to access space located below counter 32 to clamp and secure receptacle 44 to counter 32.

IV. Fourth Embodiment (FIGS. 16–20)

FIGS. 16–20 illustrate sunken receptacle unit 430, a fourth embodiment of sunken receptacle unit 30. Sunken receptacle unit 430 is identical to sunken receptacle unit 30 except that sunken receptacle unit 430 includes counter engaging member 480 in lieu of counter engaging member 80. For ease of illustration, portions of sunken receptacle unit 430 are omitted. However, counter engaging member 480 is illustrated in detail in FIGS. 16–18.

FIG. 16 is a fragmentary perspective view illustrating counter engaging member 480 mounted to rib 84 of sunken receptacle unit 430. As shown by FIG. 16, counter engaging member 480 generally includes mounting portion 492, wings 494*a*, 494*b* and wing tips 496*a*, 496*b*. Mounting portion 492 is a generally flat portion extending between wings 494*a*, 494*b*. Mounting portion 492 is configured for mating against rib 84 so as to couple counter engaging member 480 to rib 84. In the preferred embodiment illustrated, mounting portion 492 is connected to rib 84 by a plurality of connection points 486 by fasteners 487. Although not illustrated, rib 84 preferably includes a multitude of spaced connection points along the vertical length of rib 84 for enabling counter engaging member 480 to be mounted at various positions along the vertical height of wall 56.

Wings 494*a*, 494*b* are generally flat, resiliently flexible members which extend from opposite sides of mounting portion 492. Wings 494*a*, 494*b* support wing tips 496*a*, 496*b* for engagement with counter 32 (shown in FIG. 17–20). As shown by FIG. 16, wing 494*a* supports wing tip 496*a* at a height extending above wing 494*b* and wing tip 496*b*. Wings 494*a* and 494*b* enable wing tips 496*a* and 496*b*, respectively, to flex inwardly towards wall 56 during insertion of second receptacle unit 430 through opening 34 (shown in FIGS. 17–20). At the same time, wings 494*a* and 494*b* resiliently bias wing tips 496*a* and 496*b*, respectively, outward beyond opening 34 for engaging counter 32. Wings 494*a*, 494*b* are preferably configured and formed from a resiliently flexible material, such as aluminized carbon steel, for enabling wings 494*a*, 494*b* so as to resiliently bias wing tips 496*a*, 496*b*, respectively, outward beyond opening 34 for engaging counter 32. As can be appreciated, the gauge or thickness of wings 394*a*, 394*b* is highly dependent upon the particular material chosen and the degree of flexibility and resiliency required.

Wing tips 496*a* and 496*b* extend outwardly from the ends of wings 494*a*, 494*b*, respectively, for engagement with bottom surface 38 of counter 32. In the preferred embodiment illustrated, wing tips 496*a*, 496*b* extend generally perpendicular to wings 494*a* and 494*b* and generally perpendicular to wall 56. Wing tips 496*a* and 496*b* are horizontally spaced from one another at different relative heights. Each of wing tips 496*a*, 496*b* includes edges 498 and 500. Edge 498 slopes upwardly and outwardly from each of wings 494*a*, 494*b*. In contrast, edge 500 slopes upwardly and inwardly from edge 498 towards each of wings 494*a*, 494*b*. Edge 500 is a generally elongate continuous smooth surface which defines a plurality of receptacle retaining surfaces 48 along its length. Because edge 500 slopes upwardly, edge 500 can accommodate counters having various thicknesses. Counters having different thicknesses will accordingly engage different contact points along the vertically sloped surface of edge 100. Each contact point defines a distinct receptacle retaining surface 448. Because wing 494*a* supports wing tip 496*a* at a height above wing tip 496*b*, counter engaging member 480 has an even greater capability of automatically engaging the bottom surface of a counter independent of the counter's thickness.

Figure 17:
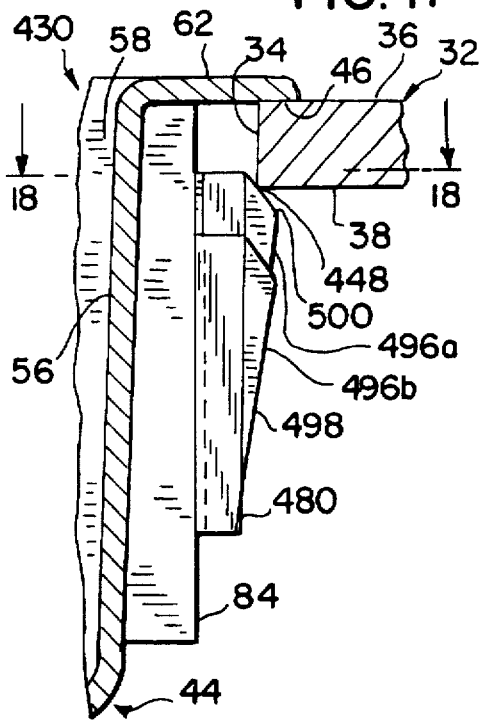
FIG. 17 is a fragmentary sectional view illustrating the fourth embodiment of the sunken receptacle unit supported adjacent a first counter having a first thickness.
Figure 18:
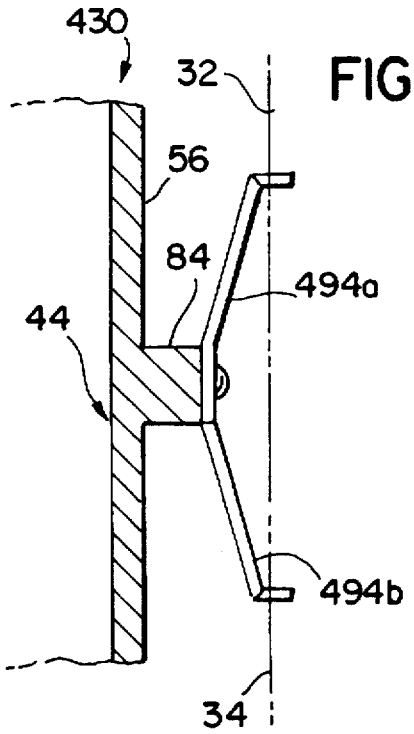
FIG. 18 is a cross-sectional view of the fourth embodiment of the sunken receptacle unit taken along lines 18—18 of FIG. 17.
Figure 19:
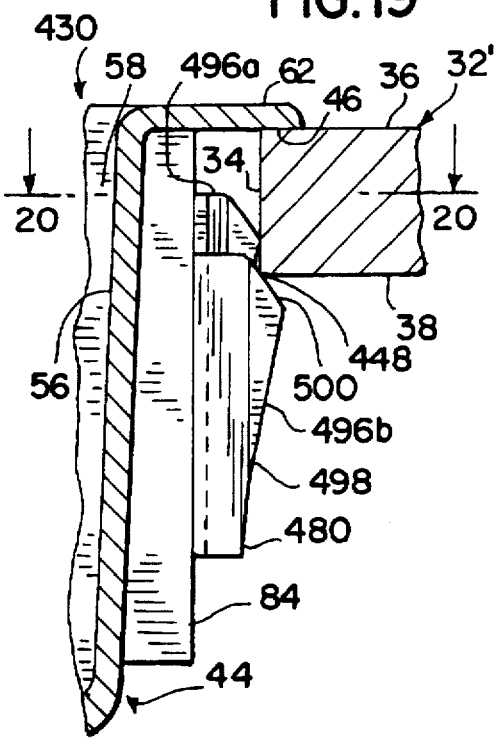
FIG. 19 is a sectional view of the fourth embodiment of a sunken receptacle unit supported adjacent a second counter having a second enlarged thickness.
Figure 20:
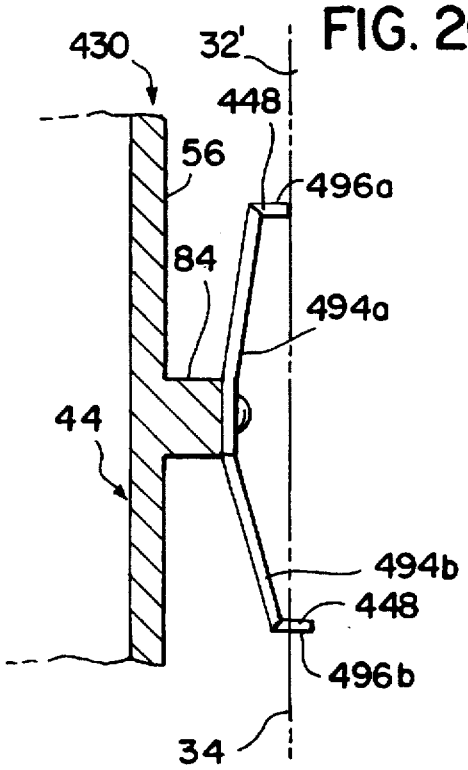
FIG. 20 is a cross-sectional view of the fourth embodiment of the sunken receptacle unit taken along lines 20—20 of FIG. 19.

FIGS. 17–20 illustrate the ability of counter engaging member 480 to engage bottom surface 38 of counter 32 independent of the thickness of counter 32. In particular, FIGS. 17 and 18 illustrate counter engaging member 480 engaging a first counter 32 having a first thickness. FIGS. 19 and 20 illustrate counter engaging member 480 engaging a second counter 32' having a second larger thickness. As is shown by FIGS. 17–20, counter engaging member 480 enables sunken receptacle unit 430 to be used with a multitude of counters having varying thicknesses. Moreover, because wings 494*a*, 494*b* automatically bias wing tips 496*a* and 496*b* into engagement with counter 32, an installer is not required to access cramped space below counter 32.

As shown by FIGS. 17 and 18, upon being inserted through opening 34 of counter 32, flange 62 of receptacle 44 rests upon top surface 36 of counter 32. At the same time, receptacle retaining surface 448 defined by wing tip 494*a* is outwardly biased by wing 494*a* into engagement with bottom surface 38 of counter 32 so as to clamp counter 32 against flange 62. During insertion of sunken receptacle unit 430 through opening 34, both wings 494*a* and 494*b* inwardly flex upon engaging counter 32. However, once edge 498 is depressed below bottom surface 48, wings 494*a* and 494*b* move towards their initial positions whereby at least one of edges 500 engage bottom surface 38 of counter 32.

FIGS. 19 and 20 disclose sunken receptacle unit 430 inserted through opening 34 of a counter 32' having a thickness greater than the thickness of counter 32. Upon insertion of sunken receptacle unit 430 through opening 34, wings 494*a* and 494*b* each inwardly flex towards wall 56 to permit insertion of sunken receptacle unit 430 through opening 34. However, once edge 498 of wing tip 496*b* is compressed below bottom surface 38 of counter 32', wing 494*b* is biased its initial position thereby forcing edge 500 of wing tip 496*b* and receptacle retaining surface 448 of wing tip 496*b* into engagement with bottom surface 38 of counter 32' to clamp counter 32' against flange 62. Due to the enlarged thickness of counter 32', wing 494*a* and wing tip 496*a* remain compressed by counter 32' towards wall 56 of receptacle 44.

V. Conclusion

In conclusion, sunken receptacle units 30, 230, 330 and 430 provide a receptacle that is easily inserted through a counter opening and clamped against the counter to provide a sanitary seal. Because receptacle retaining surfaces 48, 248, 348 and 448 are resiliently biased beyond the counter opening for engaging a bottom surface of the counter. receptacle retaining surfaces 48, 348 and 448 automatically engage the bottom surface of the counter during insertion of the receptacle to clamp the receptacle and the counter against one another. As a result, installation of sunken receptacle units 30, 230, 330, and 430 does not require an installer to access the underside of the counter to secure the sunken receptacle unit to the counter.

Because sunken receptacle unit 30, 230, 330 and 430 preferably include a plurality of receptacle retaining surfaces vertically spaced from one another, sunken receptacle units 30, 230, 330, and 430 may be used with a variety of counters having different thicknesses. Because sunken receptacle units 30, 230, 330 and 430 include a plurality of receptacle retaining surfaces horizontally spaced from one another, sunken receptacle units 30, 230, 330 and 430 are more securely secured within the counter opening. Because receptacle retaining surfaces 48, 248, 348, and 448 are resiliently biased so to engage an inner side of the counter opening, sunken receptacle units 30, 230, 330, and 430 may be securely mounted within counters having differently sized openings. Overall, sunken receptacle units 30, 230, 330 and 430 are more easily installed in counters in less time and with less expense.

Although sunken receptacle units 30, 230, 330 and 430 are illustrated as including a resilient wing which flexes to move receptacle retaining surfaces 48, 248, 348, and 448 between the first and second positions, a variety of alternative mechanisms may also be used to resiliently bias the receptacle retaining surfaces beyond the counter opening. For example, in lieu of being resiliently biased beyond the counter opening by a wing that flexes, receptacle retaining surfaces may alternatively be resiliently biased beyond the counter opening by other resilient members such as springs or other compressible materials which resiliently return to their initial shape after compression. Such alternatives are contemplated within the scope of the present invention.

Although the present invention has been described with reference to preferred embodiments, workers skilled in the art will recognize that changes may be made in form and detail without departing from the spirit and scope of the invention.

What is claimed is:

1. A sunken receptacle unit for insertion in an opening of a counter having a top surface and a bottom surface, the sunken receptacle unit comprising:

a receptacle having a bottom and a plurality of walls defining an interior cavity;

a receptacle support surface extending outwardly from the walls for supporting the receptacle within the opening; and a first receptacle retaining surface coupled to one of the walls for movement between a first position beyond the opening for engaging the bottom surface of the counter and a second position within the opening for the insertion of the unit through the opening, wherein the first receptacle retaining surface is resiliently biased in the first position.

2. The sunken receptacle unit of claim 1 wherein the first receptacle retaining surface flexes between the first and second positions.

3. The sunken receptacle unit of claim 1 wherein the first receptacle retaining surface is resiliently biased so as to engage an inner side of the opening.

4. The sunken receptacle unit of claim 1 including:

a second receptacle retaining surface vertically spaced from the first receptacle retaining surface, the second receptacle retaining surface being coupled to at least one of the walls for movement between a first position beyond the opening for engaging the bottom surface of the counter and a second position within the opening insertion of the unit through the opening, wherein the second receptacle retaining surface is resiliently biased in the first position.

5. The sunken receptacle unit of claim 1 including:

a second receptacle retaining surface horizontally spaced from the first receptacle retaining surface, the second receptacle retaining surface being coupled to one of the walls for movement between a first position beyond the opening for engaging the bottom surface of the counter and a second position within the opening for insertion of the unit through the opening, wherein the second receptacle retaining surface is resiliently biased in the first position.

6. The sunken receptacle unit of claim 1 wherein the first receptacle retaining surface is vertically adjustable along one of the walls.

7. The sunken receptacle unit of claim 1 including:

a second receptacle retaining surface horizontally and vertically spaced from the first receptacle retaining surface, the second receptacle retaining surface being coupled to one of the walls for movement between the first position beyond the opening for engaging the bottom surface of the counter and a second position within the opening for insertion of the unit through the opening, wherein the second receptacle retaining surface is resiliently biased in the first position.

8. The sunken receptacle unit of claim 1 wherein the receptacle includes:

a rib extending outwardly from at least one of the walls, wherein the rib supports the first receptacle retaining surface.

9. The sunken receptacle unit of claim 1 including:

a resilient wing coupled between the first receptacle retaining surface and said one of the walls for resiliently biasing the receptacle retaining surface in the first position.

10. The sunken receptacle unit of claim 9 wherein the resilient wing flexes about a substantially horizontal axis.

11. The sunken receptacle unit of claim 9 wherein the resilient wing flexes about a substantially vertical axis.

12. The sunken receptacle unit of claim 1 wherein the first receptacle retaining surface is substantially horizontal.

13. The sunken receptacle unit of claim 1 including:

a plurality of vertically spaced teeth coupled to said one of the walls, wherein one of the plurality of teeth defines the first receptacle retaining surface.

14. The sunken receptacle unit of claim 13 wherein each tooth has an upper horizontal surface.

15. The sunken receptacle unit of claim 13 wherein each tooth has a lower angled surface.

16. The sunken receptacle unit of claim 13 wherein a plurality of teeth extend along an axis oblique to said at least one side wall.

17. The sunken receptacle unit of claim 1 wherein the receptacle support comprises:

a flange outwardly extending from at least one of the plurality of walls for engaging the top surface of the counter.

18. The sunken receptacle unit of claim 1 including:

an elongate vertically sloped surface extending obliquely from said one of the walls, wherein the vertically sloped surface defines the first receptacle retaining surface.

19. A counter engaging mechanism for securing a receptacle within an opening of a counter having a bottom surface, the counter engaging mechanism comprising:

a mounting portion configured for being mounted to the receptacle;

a resiliently flexible wing extending from the mounting portion; and a receptacle retaining surface resiliently supported by the wing for movement between a first position beyond the opening for engaging the bottom surface and a second position within the opening for insertion of the receptacle through the opening, whereby the wing resiliently biases the receptacle retaining surface in the first position.

* * * * *